US008585306B2

(12) United States Patent
Duru et al.

(10) Patent No.: US 8,585,306 B2
(45) Date of Patent: Nov. 19, 2013

(54) COSMETIC APPLICATOR DEVICE COMPRISING A HEATER MEMBER

(75) Inventors: Nicolas Duru, Paris (FR); Denis Befve, Arras (FR); Virginie Saget, Saint-Denis (FR)

(73) Assignee: L'Oreal, Paris (FR)

( * ) Notice: Subject to any disclaimer, the term of this patent is extended or adjusted under 35 U.S.C. 154(b) by 491 days.

(21) Appl. No.: 12/746,634

(22) PCT Filed: Feb. 6, 2009

(86) PCT No.: PCT/IB2009/050498

§ 371 (c)(1), (2), (4) Date: Nov. 17, 2010

(87) PCT Pub. No.: WO2009/098667

PCT Pub. Date: Aug. 13, 2009

(65) Prior Publication Data

US 2011/0097133 A1 Apr. 28, 2011

Related U.S. Application Data

(60) Provisional application No. 61/033,344, filed on Mar. 3, 2008.

(30) Foreign Application Priority Data

Feb. 8, 2008 (FR) ..... 0850811

(51) Int. Cl.

| | |
|---|---|
| ***A45D 1/00*** | (2006.01) |
| ***A45D 1/04*** | (2006.01) |
| ***A45D 7/02*** | (2006.01) |
| ***A46B 11/04*** | (2006.01) |

(52) U.S. Cl.
USPC ..... 401/1; 401/2; 132/118; 132/206; 132/229; 132/269

(58) Field of Classification Search
USPC ..... 401/1, 2; 132/118, 206, 226, 269
See application file for complete search history.

(56) References Cited

U.S. PATENT DOCUMENTS

| | | | | |
|---|---|---|---|---|
| 4,697,066 | A * | 9/1987 | Glucksman | 219/225 |
| 4,859,835 | A * | 8/1989 | Balderson | 219/543 |
| 5,177,341 | A * | 1/1993 | Balderson | 219/543 |
| 6,197,149 | B1 * | 3/2001 | Kobayashi et al. | 156/305 |
| 6,393,213 | B1 * | 5/2002 | Bresolin | 392/498 |
| 7,224,256 | B2 * | 5/2007 | Parsons | 338/25 |
| 2005/0079166 | A1 * | 4/2005 | Damani et al. | 424/122 |
| 2005/0150509 | A1 * | 7/2005 | Gueret | 132/217 |

(Continued)

OTHER PUBLICATIONS

Polyimide Thermofoil Heaters, Minco, pp. 16-19.*

(Continued)

*Primary Examiner* — David Walczak
*Assistant Examiner* — Joshua Wiljanen
(74) *Attorney, Agent, or Firm* — Oliff & Berridge, PLC

(57) ABSTRACT

A device for applying a cosmetic or for adding finishing touches to makeup, the device comprising a heater member comprising a resistive track that is printed or that is made by etching a coating that is deposited on a substrate, the device comprising a temperature sensor that is disposed level with the heater member, the temperature sensor being in contact with the substrate, in particular in the form of a circuit that is printed or etched on the substrate.

33 Claims, 3 Drawing Sheets

(56) References Cited

U.S. PATENT DOCUMENTS

| | | | | |
|---|---|---|---|---|
| 2007/0286665 | A1* | 12/2007 | Bouix et al. | 401/1 |
| 2007/0286666 | A1 | 12/2007 | Bouix et al. | |
| 2008/0236608 | A1* | 10/2008 | Tranchant et al. | 132/218 |
| 2009/0020133 | A1 | 1/2009 | Gueret | |
| 2009/0159583 | A1* | 6/2009 | Duru | 219/201 |

OTHER PUBLICATIONS

Sep. 18, 2009 Search Report issued in International Patent Application No. PCT/IB2009/050498.

Sep. 18, 2009 Written Opinion issued in International Patent Application No. PCT/IB2009/050498.

* cited by examiner

COSMETIC APPLICATOR DEVICE COMPRISING A HEATER MEMBER

The present invention relates to an applicator for applying cosmetic or to a tool for adding finishing touches to makeup, the applicator or finishing tool comprising a heater member.

It is known to use applicators comprising a heater member in order to apply cosmetics having properties that vary as a function of temperature, e.g. cosmetics that fluidify when hot and/or that present a stringy character when hot.

It is also known to use tools comprising a heater member in order to add finishing touches to makeup, e.g. to act on a cosmetic that has already been deposited on the eyelashes.

US application No. 2005/0150509 by the Applicant discloses a heater member that extends along a curvilinear axis in a mid-plane, and that comprises a twisted resistive wire.

Known heater members present relatively high thermal inertia, thereby slowing down their rise in temperature.

In addition, cleaning heater members may turn out to be relatively difficult for some applicators or for some tools for adding finishing touches to makeup.

US applications 2007/0286666 A1 and 2007/0286665 A1 disclose flexible heater applicators. The applicator endpiece may comprise a thermochromic element that signals to the user that the working temperature has been reached.

Exemplary embodiments of the invention seek to improve still further heater-comprising applicators or tools for adding finishing touches to makeup, e.g. so as to make cleaning thereof easier and/or so as to reduce the time taken to reach the working temperature and/or so as to make it easier to control the temperature of the hot surface.

Exemplary embodiments of the invention provide a device for applying a cosmetic or for adding finishing touches to makeup, the device comprising a heater member comprising a resistive track that is printed on a substrate or that is made by etching a coating that is deposited on the substrate, the device comprising a temperature sensor present on the heater member.

By means of the temperature sensor being present on the heater member, the temperature of said heater member may be controlled more accurately.

The temperature sensor may be an electronic sensor, being for example different from a thermochromic element.

In addition, by using a resistive track, exemplary embodiments of the invention make it easier to provide a surface for coming into contact with the cosmetic that is smooth, and thus easy to clean.

The track may be made of resistive metal. In order to obtain the track, an alloy may be spread over the entire substrate, a photosensitive material may then be applied, and may then be covered by a film. Ultraviolet (UV) light may be diffused through a mask, so as to allow the UV rays to pass through only where the tracks are to be located. The resin polymerized by the UV may bond the surplus metal to the film that may subsequently be peeled off, using etched foil heater technology. It is also possible to use the material-adding technology of silk-screen printing, the track being printed at the desired locations.

The resistive track generates heat when an electric current flows therethrough.

By way of example, the heater member is arranged to reach a service temperature that is greater than 60° C.

The temperature reached at the surface for taking up the cosmetic is thus, for example, greater than or equal to about 64° C., for example, in particular equal to 64° C.±2° C., after being heated for one minute and starting from 25° C. The temperature sensor may be present on a face of the substrate opposite to the face on which the resistive track is present, the latter being the closer face to a hot surface of the device defined by the plate in contact with the heater member.

The temperature sensor may be located away from the resistive track, being positioned between an independent electrical energy source for powering the device and the resistive track.

The temperature sensor may be fitted onto a second substrate brought into contact with the substrate bearing the resistive track. The second substrate is, for instance, bonded to the substrate bearing the resistive track.

The resistive track may be made of an alloy different from the alloy used to make the temperature sensor. The resistive track is, for example, made of nickel-chromium-alloy, or of constantan, or of copper or of a chromium-iron-aluminum, while the resistive track made on the substrate to connect the temperature sensor are, for example, made of copper.

The device may comprise a temperature regulation unit configured to perform temperature regulation as a function of data received from the temperature sensor, such temperature regulation enabling, for example, to have the temperature increased quicker and, afterwards, to have the temperature substantially maintain a target-temperature. The temperature regulation unit may comprise at least one of a microcontroller, a capacitor, a resistor, and at least one switch, for example, of a transistor kind.

The regulation may be performed by the temperature regulation unit as a function of the temperature that is to be reached and may involve a proportional integral derivative (PID) regulation or, in a variant, a pulsed width regulation.

Exemplary embodiments of the invention make it possible to provide a heater member having thermal inertia that is relatively low, thereby making it possible to reduce the time taken for the heater member to reach its service temperature.

The low thermal inertia, combined with the proximity of the sensor to the heat source, may contribute to more accurate regulation.

If so desired, exemplary embodiments of the invention may also make it possible to bring the heater member to a temperature that is greater than its service temperature, e.g., more than 100° C., so as to facilitate melting of the cosmetic on contact therewith while the applicator is being loaded with cosmetic, for example, and also enabling the temperature of the heater member to decrease quickly to a service temperature that is compatible with making contact with keratinous materials, e.g., a temperature lying in the range 60° C. to 70° C. The possibility of regulating temperature accurately by means of exemplary embodiments of the invention allows such a method to be implemented.

The heater member may be in contact with a plate of thermally-conductive material that defines a surface for coming into contact with the cosmetic.

By way of example, the plate of thermally-conductive material is made of stainless steel, aluminum, or copper.

The use of stainless steel to make the plate may provide advantages in terms of safety, the use of aluminum or copper making it possible to obtain satisfactory heat production.

The plate may present a surface state that is smoother than the surface state of the heater member. If so desired, the surface for coming into contact with the cosmetic may thus be substantially smooth, thereby making it easy to clean.

The face of the heater member remote from the plate may be covered in a thermally-insulating varnish. The varnish may make it possible to prevent heat losses via said face of the heater member, thereby making it possible to redirect the heat generated by said face of the heater member to the plate. This may make it possible to generate more heat for the plate using the same electrical power, thereby making it possible to conserve energy of the energy source that is to power the heater member (e.g., an electrical source such as a battery).

In a variant, the plate is in contact with the substrate.

The plate may present a thickness lying in the range 0.05 mm to 0.25 mm.

The heater member may comprise an electrically-insulating protective film that covers the resistive track and that withstands abrasion. Such a film may make it possible to fasten the above-mentioned plate on the heater member.

The heater member may present a thickness that is less than or equal to 0.3 mm, this thickness not comprising the thickness of the above-mentioned plate. A thin heater member may make it possible to obtain low thermal inertia, and an applicator and/or a tool for adding finishing touches that is/are relatively compact.

In addition, the heater member may be made with a substrate that is flexible, thereby offering the possibility of making the surface for contacting the user in various shapes.

The above-mentioned plate may be flexible, if necessary.

The substrate bearing the temperature regulation unit may be rigid.

In a variant, said substrate may be flexible and the same substrate may bear the resistive track, the temperature sensor and the temperature regulation unit. The track may be printed or etched in such a manner as to occupy 30% to 80% of the surface of the substrate.

By way of example, the temperature sensor may be printed or etched on the substrate. The temperature sensor may be etched on the substrate on the same side as the side on which the resistive track is formed or, in a variant, on the opposite side.

The temperature sensor may comprise a thermocouple that is engraved or printed simultaneously with the heat-producing track(s), the thermocouple comprising two track portions of different materials deposited in contact with each other. When temperature varies, a potential difference may be created, the potential difference being transmitted by the electrical contacts of the thermocouple. In a variant, the temperature probe may comprise a thermistor that is engraved simultaneously with the heat-producing track(s).

The substrate may be made of polyimide.

By way of example, the protective film is made of polyimide, since polyimide possesses good mechanical properties and withstands heat over a wide range of temperatures.

Selecting polyimide to make both the substrate and the protective film may make it possible to obtain a heater member that is particularly flexible and thin.

However, the invention is not limited to using polyimide to make the substrate.

In a variant, the substrate and the protective film may be made of mica, silicone elastomer, or transparent polyester. Such materials may make it possible to obtain flexibility that is adaptable to complex shapes and to different operating temperatures.

Still in a variant, the substrate may be made of fiber-filled epoxy resin, and the protective film may be made of polyimide.

The ratio between the thickness of the protective film and the thickness of the substrate may vary depending on the material selected.

In particular for a substrate and for a protective film made of polyimide, the heater member may present a thickness lying in the range 100 micrometers (μm) to 300 μm, e.g., being about 200 μm. The heater member may present flexibility that enables it to be curved up to a minimum radius of curvature of 0.5 millimeters (mm) in any axis in the plane of the heater member, for example.

By way of example, the heater member may be fitted via its face remote from the face for receiving the above-mentioned plate, on a support surface of an applicator head of the applicator.

The applicator head may comprise a support surface that matches the shape of the heater member, at least in part. The heater member may be plane. In a variant, the heater member need not be plane. By way of example, the heater member may present at least a portion that is concave or convex. A concave shape may make it possible to apply makeup to a curved zone of the face, such as a set of eyelashes, for example.

In exemplary embodiments of the invention, the applicator head comprises at least one portion in relief providing protection against high temperatures and surrounding the heater member, at least in part.

The protective portion in relief may be overmolded or fitted on at least a portion of the heater member, optionally being made integrally with the applicator head. The protective portion in relief may project relative to the heater member by a height lying in the range 0.5 mm to 2 mm, e.g., being made in the form of a lip that may extend in an optionally continuous manner around the heater member, and optionally being superposed on the heater member.

The protective portion in relief may comprise a plurality of projecting elements. Where appropriate, the projecting elements may be superposed on the heater member, e.g., being made in the form of ribs, e.g., transverse ribs.

Where appropriate, the applicator head may also comprise at least one row of teeth that may serve to comb the eyelashes.

The device may comprise an electrical circuit for powering the heater member, said circuit comprising an independent electrical energy source, e.g., one or more optionally-rechargeable batteries.

The heater member may be electrically powered by means of electric wires, or via two zones of contact under pressure between metal parts, in which event, the contacts on the heater member may comprise a small track zone that is wider than the remainder of the track, and that is not covered by the protective film. Wider track may be directly printed or made by etching a coating that is deposited on the substrate, said substrate extending, for example, within the device to come into contact with the electrical energy source.

By way of example, the heater member is powered by two electrical conductors that are connected to a single longitudinal or lateral edge of the substrate. In a variant, the heater member is powered by two electrical conductors that are connected respectively to two opposite longitudinal or lateral sides of the substrate.

The heater member may be arranged in such a manner as to present, in operation, a power density that lies in the range 0.4 watts per square centimeter ($W/cm^2$) to 0.6 $W/cm^2$.

The device may extend along a longitudinal axis. The heater member may extend generally parallel to the longitudinal axis, or, in a variant, generally perpendicularly to the longitudinal axis, e.g. having at least one portion that is parallel to the longitudinal axis of the applicator, or at least one portion that is perpendicular to the longitudinal axis of the applicator.

Other exemplary embodiments of the invention also provide a packaging and applicator device for applying a cosmetic, the device comprising:

- a container containing the cosmetic; and
- a device for applying a cosmetic or for adding finishing touches to makeup, as defined above.

The cosmetic may be for application to keratinous fibers, being a mascara that is stringy when hot, for example.

Other exemplary embodiments of the invention also provide a method of applying makeup and/or of adding finishing touches to makeup, in which method a cosmetic is applied to keratinous materials by means of a device for applying a cosmetic or for adding finishing touches to makeup, as defined above.

Independently of the presence or absence of a temperature sensor, other exemplary embodiments of the invention provide a device for applying a cosmetic or for adding finishing touches to makeup, comprising a heater member, said heater member comprising a resistive track that is printed on a substrate or that is made by etching a coating that is deposited on a substrate, the heater member presenting a face in contact with a plate of thermally-conductive material that defines a surface for coming into contact with the cosmetic. Such a device may present one or more of the above-mentioned characteristics.

The invention may be better understood on reading the following description of non-limiting embodiments thereof, and on examining the accompanying drawings, in which.

Figure 7:
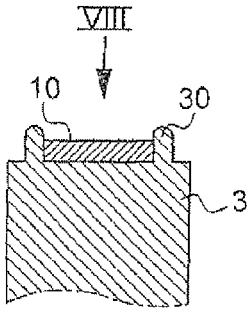
Figure 9:
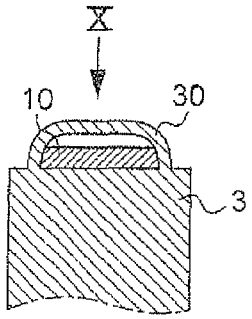
Figure 11:
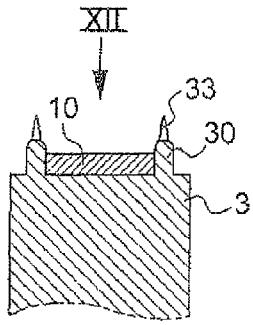
Figure 8:
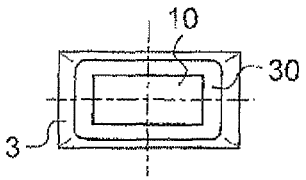
Figure 10:
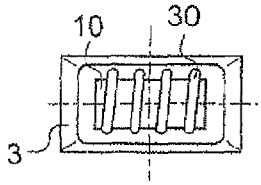
Figure 12:
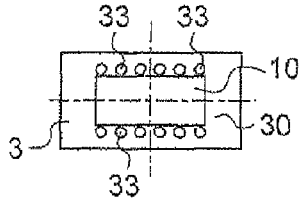
Figure 13:
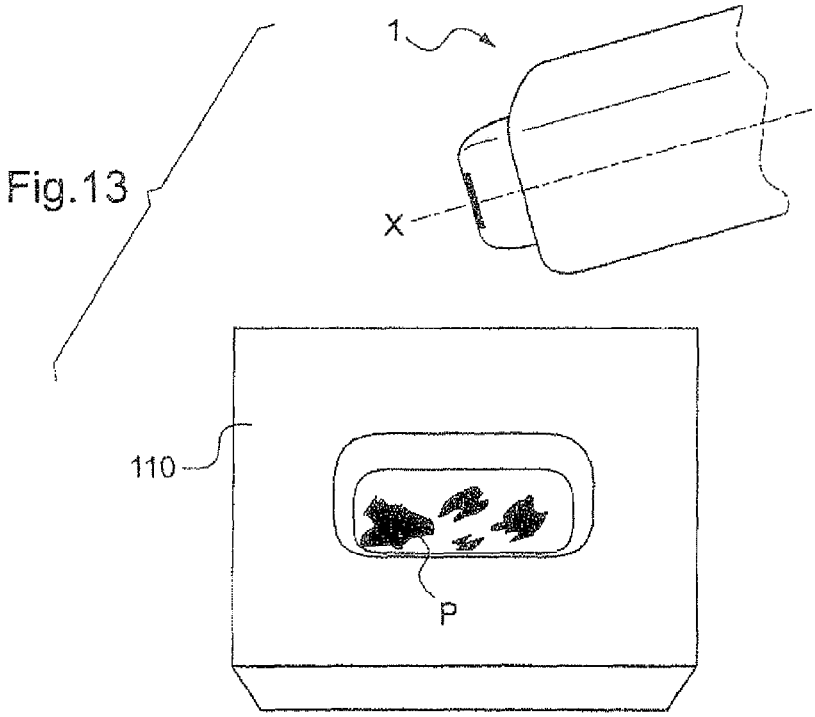
Figure 14:
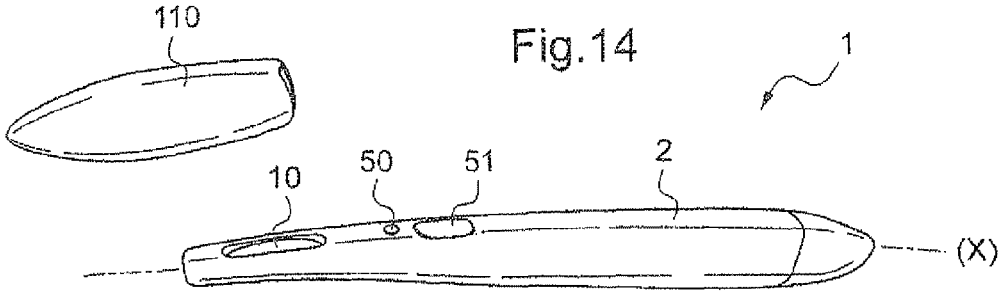
Figure 15:
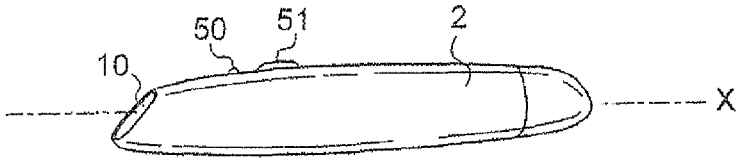
Figure 16:
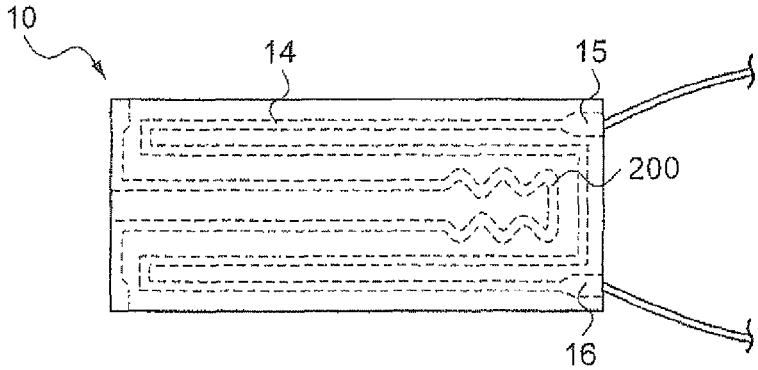

FIGS. 7, 9, and 11 are diagrammatic and fragmentary sections of devices;

FIGS. 8, 10, and 12 are plan views as seen looking along arrows VIII, X, and XII respectively, in FIGS. 7, 9, and 11;

FIG. 13 shows a device comprising an exemplary applicator and its associated container;

FIGS. 14 and 15 are fragmentary and diagrammatic views of devices according to other exemplary embodiments of the invention; and FIG. 16 shows a variant embodiment of the heater member.

Figure 1:
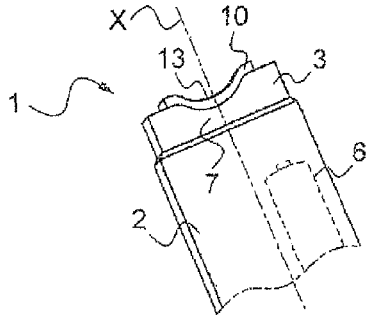
FIG. 1 is a diagrammatic and fragmentary view of a device according to exemplary embodiments of the invention.

FIG. 1 is a fragmentary view showing a device 1 according to exemplary embodiments of the invention, said device being suitable for being used as an applicator or as a tool for adding finishing touches to makeup.

The device 1 comprises a body 2 serving as a handle and extending along a longitudinal axis X, said body being extended at one end by an applicator head 3 carrying a heater member 10.

In the example described, the body 2 serves to house an independent electrical energy source 6 shown very diagrammatically, e.g. one or more 1.5 V batteries or a rechargeable battery.

Figure 3:
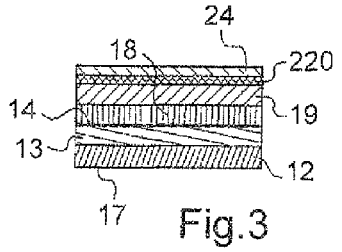
FIG. 3 is a cross-section on III-III of the FIG. 2 heater member.
Figure 2:
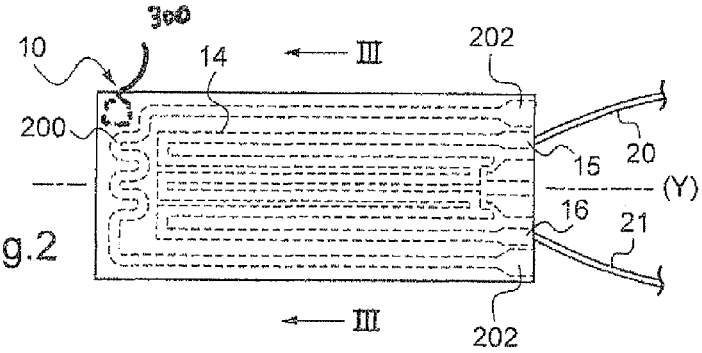
FIG. 2 shows a front view of an example of a heater member.

FIGS. 2 and 3 show an example of a heater member 10.

As may be seen in FIG. 3, the heater member 10 comprises a substrate 12, e.g., made of polyimide, that presents a thickness lying in the range 15 μm to 30 μm, for example, in particular 25 μm.

As may be seen in FIG. 3, the substrate is surmounted by a layer 13 of adhesive, said layer presenting a thickness of 25 μm, for example.

In addition, the heater member 10 comprises a resistive track 14, e.g., deposited on the substrate 12 and then etched. In the example described, the resistive track 14 is surmounted by a layer 18 of adhesive, said layer 18 presenting a thickness of 25 μm and being covered by the protective film 19, the protective film having a thickness of 25 μm, for example, and being made of polyimide, for example.

By way of example, the resistive track 14 occupies 30% to 80% of the surface of a face of the substrate 12.

The heater member 10 also comprises a temperature sensor 200. By way of example, the temperature sensor 200 is also made by etching a printed circuit, and, by way of example, may comprise two tracks made of different materials that form a thermocouple, or one track presenting electrical resistance that varies as a function of temperature.

By way of example, the temperature sensor 200 is connected to electrical contacts 202, making it possible for electrical conductors (not shown) to read the temperature.

The temperature sensor 200 may be provided on the same face of the substrate as the resistive track.

In a variant not shown, the temperature sensor 200 may be provided on a face opposite to the face on which the resistive track 14 is provided.

In another variant, the temperature sensor 200 may be located at a distance from the resistive track, being positioned between the electrical energy source 6 and the track 14.

The temperature sensor 200 may be fitted onto a second substrate brought into contact with the substrate bearing the resistive track 14. The second substrate is for instance bonded to the substrate 12 bearing the resistive track 14.

The temperature sensor 200 is for example a sensor of reference ERTJ1W473H from the supplier PANASONIC®.

The device may also comprise a temperature regulation unit 300.

The temperature regulation unit 300 comprises for example a microcontroller, capacitors, resistors and at least one transistor-kind switch, for example a MOSFET transistor.

The microcontroller is for example of reference Tiny 13V from the supplier ATMEL® or of reference S3F9454 from the supplier SAMSUNG®.

The regulation may be performed by the temperature regulation unit as a function of the temperature that is to be reached and may involve a proportional integral derivative (PID) regulation or, in a variant, a pulsed width regulation.

In the embodiment shown, the resistive track 14, the temperature sensor 200 and the temperature regulation unit 300 are provided on the same substrate 12 but the temperature regulation unit may also be provided on a separate substrate.

The substrate 12 presents a rear face 17 remote from the resistive track 14, with said substrate being fitted via its rear face 17 to a support surface 7 of the applicator head 3.

By way of example, the support surface 7 presents a shape that matches the shape of the rear face 17 of the substrate 12, at least in part.

By way of example, the rear face 17 of the substrate 12 is covered by a thermally-insulating varnish.

The unit, constituting the heater member 10, formed by the substrate 12, the resistive track 14, the layers 13 and 18 of adhesive, and the protective film 19 may present a thickness lying in the range 0.1 mm to 0.3 mm.

Beside the protective film 19, and as shown in FIG. 3, the heater member 10 may be covered by a metal plate 24, e.g., made of stainless steel, the plate 24 being bonded onto the protective film 19, for example.

Where appropriate, a double-sided adhesive layer 220 that is sensitive to pressure may be placed between the protective film 19 and the plate 24.

In a variant, the plate 24 may be held on the heater member 10 by the applicator head 3. The outside face of the plate 24 may define the surface of the device 1 for coming into contact with the cosmetic.

In the example shown in FIG. 2, the resistive track 14 is connected at its two ends 15 and 16 to two respective electrical power supply conductors 20 and 21.

The two ends 15 and 16 of the track 14 are situated in the proximity of a single edge of the substrate 12 in the example in FIG. 2.

The track 14 may be printed in such a manner as to extend mostly parallel to the longitudinal axis Y of the substrate, as shown in FIG. 2.

Of course, the invention is not limited to such an examplary embodiment of a track, the track possibly comprising at least a portion that extends transversally relative to the axis, indeed that extends mostly transversally relative to the longitudinal axis Y of the substrate.

Figure 4:
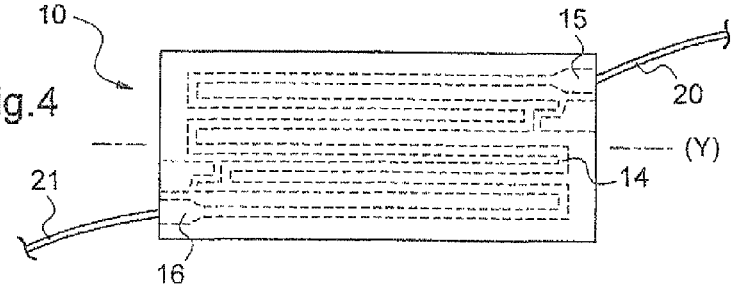
FIG. 4 shows a variant of a heater member.

In the variant in FIG. 4, the two ends of the track 14 connected to the power supply conductors are respectively adjacent to two opposite lateral edges of the substrate 12.

In FIG. 4, the temperature sensor 200 and the temperature regulation unit 300 are not shown for the purpose of clarity of the drawing.

By way of example, the heater member 10 presents a nominal power of 0.8 W and makes it possible to reach a temperature of about 65° C. in 18 seconds (s) and a temperature of 105° C. in less than one minute when it is powered by two 1.5 V batteries in series.

In an example, the heater member 10 is of rectangular shape, of dimensions 35 mm by 5 mm, and may be covered by a plate 24 made of 0.2 mm thick stainless steel.

In another example, the heater member 10 comprises a substrate 12 made of epoxy, and a protective film 19 made of polyimide. Such a heater member 10 may be found to be suitable for applications in which it is desirable to obtain a temperature of the heater member 10 that is less than 200° C.

Such a heater member 10 comprising an epoxy substrate may also present satisfactory thermal inertia. In another example, the heater member 10 comprises a substrate 12 made of thermoresistive silicone, and a protective film 19 also made of silicone. Such a heater member 10 is suitable for applications in which it is desirable to obtain a heater member presenting great flexibility and reaching a temperature that may be as high as 250° C.

In the example shown in FIG. 1, the heater member 10 presents a shape that is outwardly concave.

By way of example, the substrate 12 presents a central portion 13 that presents a curved portion with a maximum setback of about 3 mm.

In this example, the heater member 10 extends generally perpendicularly to the longitudinal axis X.

The invention is not limited to a heater member 10 that presents a concave shape, and the heater member 10 may be outwardly convex.

Figure 5:
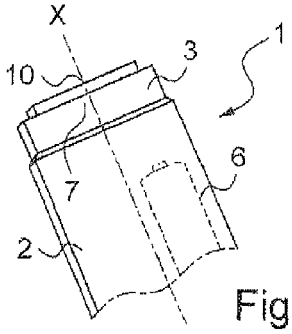
FIGS. 5 and 6 are views similar to FIG. 1 showing devices according to other exemplary embodiments of the invention.
Figure 6:
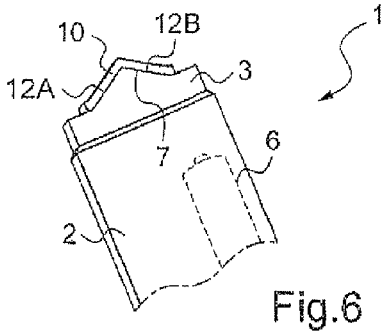

FIGS. 5 and 6 show heater members 10 having shapes that are different.

In the example in FIG. 5, the heater member 10 is planar and extends generally perpendicularly to the longitudinal axis X.

In the example in FIG. 6, the heater member 10 presents two portions 12*a* and 12*b* that slope towards each other and outwards, forming between them a vertex angle lying in the range 90° to 170°. The invention is not limited to a heater member 10 that extends generally perpendicularly to the longitudinal axis X.

FIG. 14 shows a device according to other exemplary embodiments of the invention.

In this example, the heater member 10 is for example similar to the heater member described with reference to FIG. 3, and extends parallel to the axis X of the body 2 of the device.

By way of example, the heater member 10 is arranged in such a manner that the substrate 12 extends over a length that is sufficient to support the resistive track 14 and a conductive track that is connected to the resistive track 14 and to which the electrical conductors 20 and 21 are soldered, which may thus make it possible to distance the conductive track from the resistive track 14, thereby making it possible to limit the space occupied around the heater member 10.

As may be seen in FIG. 14, the heater member may comprise an indicator light 50, e.g. constituted by a light-emitting diode (LED), and a button 51 serving to power the heater member 10 by means of the independent electrical energy source 6, shown in diagrammatic manner.

The button 51 is for example a pushbutton or, in a variant, a button configured to be actuated via a sliding motion parallel to a surface.

When the button 51 is configured for sliding, it may be moved along the substrate to optionally connect the resistive track 14, depending on its position, so as to power the heater member 10.

In the example shown in FIG. 14, the heater member 10 has a shape that is outwardly convex. Of course, the invention is not limited to such a shape for the heater member 10. By way of example, the device shown in FIG. 14 may comprise a heater member 10 that is planar in shape.

As may be seen in FIG. 14, the device 1 may be associated with a cap 110 that constitutes a reservoir containing the cosmetic for application. By way of example, the cap 110 is arranged to be mounted on the device 1 by snap-fastening by means of portions in relief (not shown).

By way of example, the cosmetic P is makeup for the eyelashes, presenting a property that varies as a function of temperature, in particular being stringy when hot.

The device 1 may be associated with a container 110 that contains the cosmetic P for application, as shown in FIG. 13.

FIG. 15 shows a device according to other exemplary embodiments of the invention.

In this example, the device may be used for applying a lipstick. By way of example, the device 1 comprises a heater member 10 that is disposed at one of the longitudinal ends of the body 2. As may be seen in FIG. 15, the heater member 10 slants relative to the longitudinal axis X of the body 2, for example.

The device may also be associated with a cap that constitutes a reservoir of cosmetic for application, or it may be associated with another container.

In the exemplary embodiment shown in FIG. 15, and by way of example, the body 2 presents an average diameter of 12 mm and the heater member is powered to present a heating power of 0.41 W/cm$^2$.

FIGS. 7, 9, and 11 show, in section, examples of applicator heads 3, each comprising a protective portion in relief 30.

The protective portion in relief 30 is made out of a plastics material that withstands the maximum temperature reached by the heater member 10.

In the exemplary embodiment shown in FIG. 7, the protective portion in relief 30 surrounds the heater member 10, being in the form of a lip of height h above the heater member 10 that lies in the range 0.5 mm to 2 mm. The lip may optionally be continuous around the heater member 10.

In the exemplary embodiment shown in FIG. 9, the protective portion in relief comprises a plurality of transverse ribs 30 that cover the heater member 10.

In the exemplary embodiment shown in FIG. 11, the protective portion in relief is in the form of a lip 30 that surrounds the heater member 10 as in the exemplary embodiment in FIG. 7. Projecting elements 33, e.g. teeth, are disposed on either side of the heater member 10, the teeth being molded integrally with the lip 30, for example.

The temperature sensor 200 may also be disposed on the substrate in such a manner as to be situated substantially in the middle of the heater member, thereby increasing the accuracy with which it reads temperature.

The invention is not limited to the embodiments described above, and their characteristics may be combined within variants that are not shown.

The expression "comprising a" should be understood as being synonymous with "comprising at least one", unless specified to the contrary.

The invention claimed is:

1. A device for applying a cosmetic or for adding finishing touches to makeup, the device comprising:

a heater member including a resistive track that is printed on a substrate or that is made by etching a coating that is deposited on the substrate, the heater member presenting a face for heating a plate of thermally-conductive material that defines a surface for coming into contact with the cosmetic;

a temperature sensor present on the heater member; and a temperature regulation unit performing temperature regulation as a function of data received from the temperature sensor.

2. A device according to claim 1, the temperature sensor being disposed substantially in the middle of the heater member.

3. A device according to claim 1, the temperature sensor being in contact with the substrate.

4. A device according to claim 1, the heater member comprising a protective film that covers the resistive track.

5. A device according to claim 4, the plate being in contact with the protective film.

6. A device according to claim 4, the protective film being made of polyimide.

7. A device according to claim 1, the heater member presenting a thickness that is less than or equal to 0.3 mm.

8. A device according to claim 1, the plate being made of metal.

9. A device according to claim 1, the plate being in contact with the substrate.

10. A device according to claim 1, the heater member comprising a face that is covered in a thermally-insulating varnish.

11. A device according to claim 1, the resistive track occupying 30% to 80% of a surface of a face of the substrate.

12. A device according to claim 1, the substrate being made of polyimide, epoxy, mica, or polyester.

13. A device according to claim 1, the heater member being fitted via a face on a support surface of an applicator head of the device.

14. A device according to claim 13, the heater member being fitted onto the support surface via its face remote from the resistive track.

15. A device according to claim 13, the support surface of the applicator head matching the shape of the heater member, at least in part.

16. A device according to claim 13, the applicator head comprising at least one portion in relief providing protection against high temperature and surrounding the heater member, at least in part.

17. A device according to claim 16, the protective portion in relief projecting relative to the heater member by a height lying in the range 0.5 mm to 2 mm.

18. A device according to claim 16, the protective portion in relief being in the form of a lip.

19. A device according to claim 13, the applicator head comprising at least one row of teeth.

20. A device according to claim 1, the heater member being planar.

21. A device according to claim 1, the heater member not being planar.

22. A device according to claim 1, the heater member presenting at least a portion that is outwardly concave.

23. A device according to claim 1, further comprising an electrical circuit for powering the heater member, said circuit comprising an independent electrical energy source.

24. A device according to claim 23, the electrical circuit powering the heater member via two conductors that are connected to a single longitudinal or lateral edge of the heater member, or via two zones of contact under pressure.

25. A device according to claim 1, extending along a longitudinal axis, the heater member extending generally parallel to the longitudinal axis.

26. A device according to claim 1, extending along a longitudinal axis, the heater member extending generally perpendicularly to the longitudinal axis.

27. A device according to claim 1, the resistive track being etched or silk-screen printed.

28. A device according to claim 1, the heater member being arranged in such a manner as to present, in operation, a power density that lies in the range 0.4 $W/cm^2$ to 0.6 $W/cm^2$.

29. A device according to claim 1, the surface for coming into contact with the cosmetic extending over one side only of the device.

30. A device according to claim 29, the surface for coming into contact with the cosmetic being planar or curved about a rectilinear axis that is perpendicular to a longitudinal axis of the device.

31. A device according to claim 1, the temperature reached at the heater member surface that takes up the cosmetic being greater than or equal to about 64° C., after being heated for one minute and starting from 25° C.

32. A packaging and applicator unit for applying a cosmetic, the unit comprising:

a container containing the cosmetic; and a device for applying the cosmetic or for adding finishing touches to makeup, as defined in claim 1.

33. A packaging and applicator unit according to claim 32, the cosmetic being for application to keratinous fibers.

* * * * *